US010179082B2

(12) United States Patent
Davis et al.

(10) Patent No.: US 10,179,082 B2
(45) **Date of Patent: *Jan. 15, 2019**

(54) COMPRESSIVE THERAPEUTIC DEVICE

(71) Applicant: NIKE, Inc., Beaverton, OR (US)

(72) Inventors: Carrie L. Davis, Beaverton, OR (US); Lee D. Peyton, Tigard, OR (US); Eric S. Schindler, Beaverton, OR (US); Bradley W. Wilkins, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 564 days.

This patent is subject to a terminal disclaimer.

(21) Appl. No.: 14/836,451

(22) Filed: Aug. 26, 2015

(65) Prior Publication Data

US 2015/0359700 A1 Dec. 17, 2015

Related U.S. Application Data

(63) Continuation of application No. 13/474,442, filed on May 17, 2012, now Pat. No. 9,144,530.

(51) Int. Cl.
*A61H 9/00* (2006.01)

(52) U.S. Cl.
CPC ..... *A61H 9/0085* (2013.01); *A61H 2201/164* (2013.01); *A61H 2201/165* (2013.01); *A61H 2201/5002* (2013.01); *A61H 2201/5058* (2013.01); *A61H 2201/5069* (2013.01); *A61H 2201/5071* (2013.01); *A61H 2201/5084* (2013.01); *A61H 2205/106* (2013.01); *A61H 2209/00* (2013.01)

(58) Field of Classification Search
CPC ..... A61H 9/0085; A61H 2209/00; A61H 2205/106; A61H 2201/5084; A61H 2201/5071; A61H 2201/5058; A61H 2201/5002; A61H 2201/165; A61H 2201/164; A61H 2201/5069
See application file for complete search history.

(56) References Cited

U.S. PATENT DOCUMENTS 4,805,601 A 2/1989 Eischen, Sr.
4,938,207 A 7/1990 Vargo
(Continued)

FOREIGN PATENT DOCUMENTS

GB 2263405 A * 7/1993 ..... A61H 23/04

*Primary Examiner* — Quang D Thanh
(74) *Attorney, Agent, or Firm* — Honigman Miller Schwartz and Cohn LLP; Matthew H. Szalach; Jonathan P. O'Brien

(57) ABSTRACT

A device for compressing an extremity of a user includes a wearable support member operable to be worn on the extremity of the user. The device also includes a plurality of chamber members that are arranged across and coupled to the support member. The chamber members each have a respective chamber therein. The chamber is at least partially defined by a base wall that is disposed adjacent the support member, a side wall that is attached to and that extends away from the base wall, and a top wall that is attached to the side wall and that is spaced away from the base wall. Furthermore, a foot pump member is operable to be disposed underneath a foot of the user. The foot pump member is operable to change a pressure inside the chambers as a result of being stepped upon by the user.

19 Claims, 6 Drawing Sheets

(56) References Cited

U.S. PATENT DOCUMENTS

| | | | | |
|---|---|---|---|---|
| 5,263,473 | A | 11/1993 | McWhorter | |
| 5,348,530 | A | 9/1994 | Grim et al. | |
| 5,407,421 | A | 4/1995 | Goldsmith | |
| 5,520,622 | A | 5/1996 | Bastyr et al. | |
| 5,711,760 | A | 1/1998 | Ibrahim et al. | |
| 5,968,073 | A | 10/1999 | Jacobs | |
| 5,989,204 | A | 11/1999 | Lina | |
| 6,273,866 | B2 | 8/2001 | Thomas et al. | |
| 6,387,064 | B1 * | 5/2002 | Gunnon | A43B 7/00 601/148 |
| 6,494,852 | B1 | 12/2002 | Barak et al. | |
| 7,008,390 | B2 | 3/2006 | Miotto et al. | |
| 7,258,676 | B2 | 8/2007 | Calderon et al. | |
| 9,144,530 | B2 * | 9/2015 | Davis | A61H 9/0085 |
| 2003/0013997 | A1 | 1/2003 | Raju | |
| 2003/0153857 | A1 | 8/2003 | McCarthy et al. | |
| 2005/0027221 | A1 | 2/2005 | Calderon et al. | |
| 2006/0189905 | A1 | 8/2006 | Eischen | |
| 2007/0167884 | A1 * | 7/2007 | Mangrum | A61H 9/005 601/6 |
| 2007/0249977 | A1 | 10/2007 | Bonnefin et al. | |
| 2007/0282230 | A1 | 12/2007 | Valderrabano et al. | |
| 2009/0204037 | A1 | 8/2009 | Ravikumar | |
| 2009/0234260 | A1 | 9/2009 | Coward et al. | |
| 2010/0249680 | A1 | 9/2010 | Davis | |
| 2011/0295168 | A1 * | 12/2011 | Mangrum | A61H 9/005 601/152 |

* cited by examiner

COMPRESSIVE THERAPEUTIC DEVICE

CROSS REFERENCE TO RELATED APPLICATION

This application is a Continuation of U.S. Pat. No. 9,144,530, filed May 17, 2012, the contents of which are hereby incorporated by reference in their entirety.

FIELD

The present disclosure relates to a therapeutic device and, more particularly, compressive therapeutic devices that selectively compress an extremity of a user to promote circulation therein.

BACKGROUND

Typically, oxygenated blood flows from the heart into the legs and other extremities to feed the muscles and promote healthy muscle function. After delivering oxygen and other nutrients to the muscles, deoxygenated blood removes waste products, such as carbon dioxide, from the muscles in preparation for another cycle of muscle contractions.

Blood can flow from the extremities (e.g., legs and arms) back to the heart against the natural pull of gravity. Accordingly, a venous pump system can facilitate blood flow from the extremities back to the heart against gravity. A natural venous pump in the legs includes a series of valves and smooth muscle lining the blood vessels that propel blood towards the heart and inhibit backflow of the blood.

Under normal conditions, the venous pump system of the extremities returns blood to the heart in an efficient fashion. However, certain conditions (e.g., during exercise, post-trauma, surgery, other medical conditions, etc.) can cause the blood to flow less efficiently through the extremities and/or cause the muscles to require more oxygen and increased waste removal than can be supported by the body's natural circulation.

Certain devices and techniques have been proposed for improving circulation through the extremities. For instance, external devices can be used to increase circulation by cyclically compressing and releasing the extremity. For example, compression wraps having fluid-filled bladders can cyclically apply and release pressure. The bladders are cyclically inflated and deflated with use of an electric pump, etc. Other examples include systems in which discrete, fluid-filled bladders having a constant pressure are placed in various locations around a wrap or brace such that they are situated between portions of the wrap or brace and a wearer's skin to increase comfort and stability during use.

SUMMARY

A device for compressing an extremity of a user is disclosed. The device includes a wearable support member operable to be worn on the extremity of the user. The device also includes a plurality of chamber members that are arranged across and coupled to the support member. The chamber members each have a respective chamber therein. The chamber is at least partially defined by a base wall that is disposed adjacent the support member, a side wall that is attached to and that extends away from the base wall, and a top wall that is attached to the side wall and that is spaced away from the base wall. Furthermore, a foot pump member is operable to be disposed underneath a foot of the user. The foot pump member is operable to change a pressure inside the chambers as a result of being stepped upon by the user.

Moreover, a device for compressing an extremity of a user is disclosed. The device includes a wearable support member operable to be worn on the extremity of the user. Furthermore, the device includes a projectable chamber member that is coupled to the support member and that includes a projectable wall operable to abut against the extremity of the user. The projectable wall at least partially defines a chamber within the chamber member, and the projectable wall has a first portion and a second portion. The second portion has a recessed position relative to the first portion, and the second portion also has an extended position relative to the first portion. Additionally, the device includes a pump member that is operable to change a pressure inside the chamber to thereby move the second portion between the recessed position and the extended position.

Additionally, a device for compressing a lower leg of a user is disclosed. The device includes a wearable support member operable to wrap about and secure to the lower leg of the user. The device also includes a plurality of rounded, cylindrical chamber members that each defines a respective chamber therein. The chamber members are removably coupled to the support member and are arranged in a plurality of rows and columns thereon. Also, the chamber are at least partially defined by a base wall that is disposed adjacent the support member, an annular side wall that is attached to and that extends away from the base wall, and a top wall that is attached to the side wall and that is spaced away from the base wall. The top wall of a first group of the chamber members is substantially flat, and the top wall of a second group of the chamber members has a first portion and a second portion. The second portion has a recessed position relative to the first portion, and the second portion also has an extended position relative to the first portion. Furthermore, the device includes a foot pump member that is operable to be disposed underneath a foot of the user. The foot pump member is operable to change a pressure inside the chambers and move the second portion between the recessed and extended positions as a result of being stepped upon by the user. In addition, the device includes an article of footwear that supports the foot pump member and a secondary pump member that is fluidly and removably connected to the chambers to change the pressure inside the chambers and to move the second portion between the recessed and extended positions.

This section provides a general summary of the disclosure and is not a comprehensive disclosure of the full scope or all of the features of the disclosure. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations. The drawings are not intended to limit the scope of the present disclosure.

FIGS. 3B and 3C are perspective views of additional embodiments of a chamber member of the compression device of FIG. 2, wherein FIG. 3B shows the chamber member in a recessed position and FIG. 3C shows the chamber member in an extended position;

Corresponding reference numerals indicate corresponding parts throughout the several views of the drawings.

DETAILED DESCRIPTION

Figure 1:
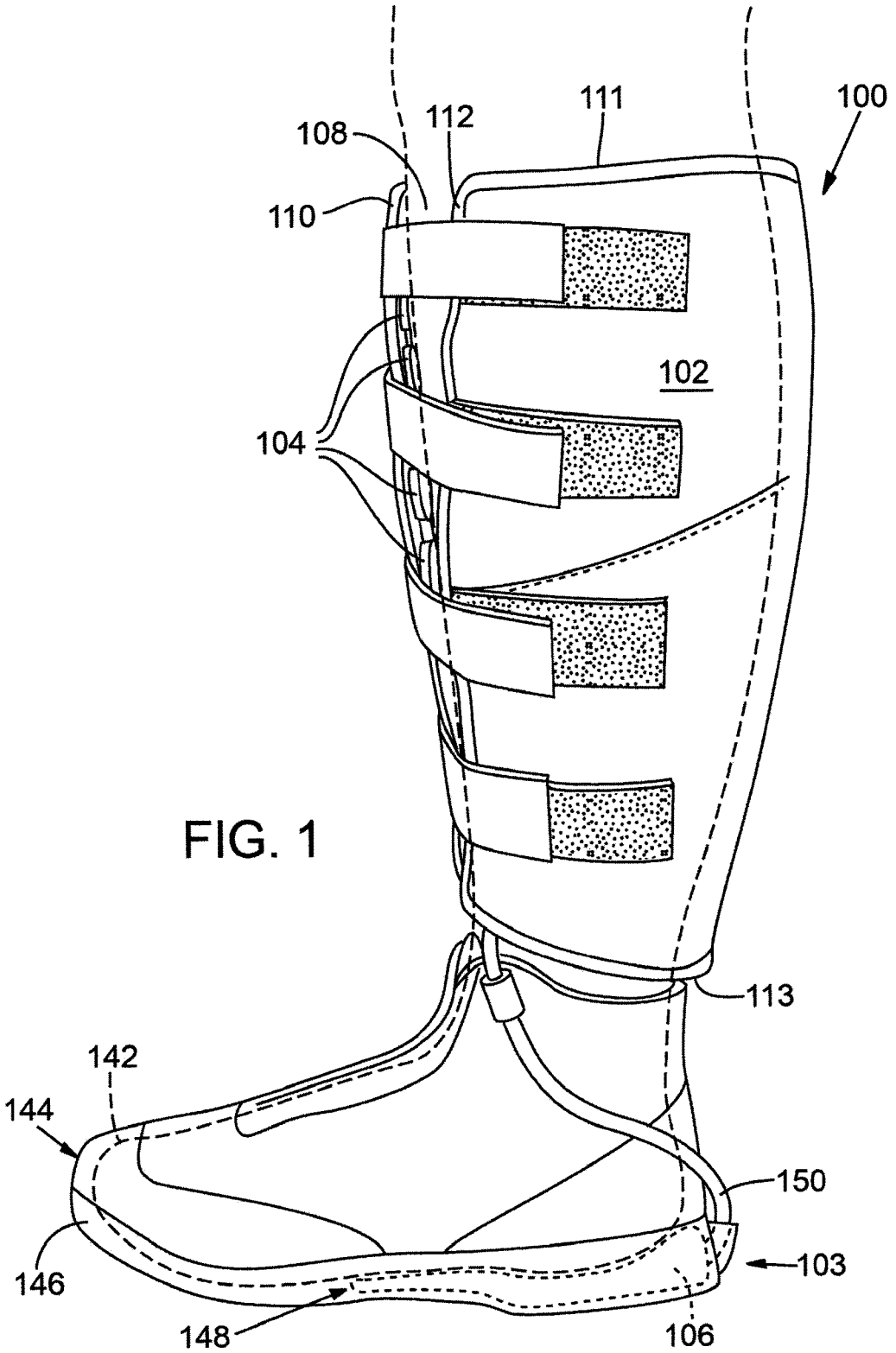
FIG. 1 is a side view of a compression device according to exemplary embodiments of the present disclosure.

FIG. 1 illustrates exemplary embodiments of a leg compression device 100 according to various aspects of the present disclosure. As will be discussed, the device 100 can be used for cyclically compressing and releasing an extremity of a user 108 (shown in phantom). As such, the device 100 can improve blood circulation, provide pain relief to the user 108, and/or can provide other benefits.

The compression device 100 can generally include a wearable support member 102 operable to be worn on and about an extremity of the user 108 (i.e., wearer). The support member 102 can be a sheet of material having one or more layers. In the embodiments illustrated, the support member 102 wraps about the lower leg of the user 108; however, it will be appreciated that the support member 102 can be worn on any area of any extremity of the user 108. For instance, the support member 102 can be wrapped around an upper portion of the wearer's leg or can be wrapped around both the upper and lower leg. In additional embodiments, the support member 102 is a sleeve that wraps around another extremity of the user 108, such as the wearer's arm. The support member 102 can also be included in an article of manufacture such as a pair of pants, leg warmers, a shirt, etc.

Figure 2:
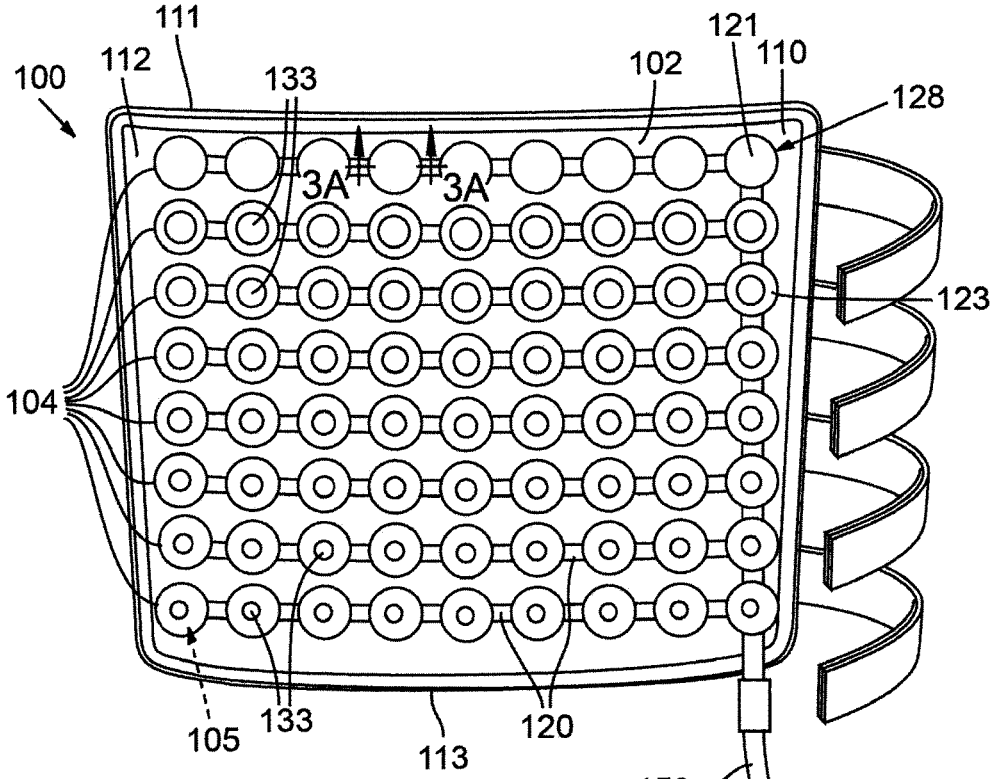
FIG. 2 is a plan view of the compression device of FIG. 1.

As shown in FIGS. 1 and 2, the compression device 100 can also include a plurality of chamber members 104 that are operably secured to the support member 102. As shown in FIG. 2, the chamber members 104 can be rounded and cylindrical and can be arranged across and coupled to the support member 102. The chamber members 104 can each define a respective chamber 105 therein (FIG. 3). Also, two or more of the chambers 105 (e.g., all of the chambers 105) can be fluidly connected to each other. Moreover, one or more of the chamber members 104 (and thus the volume and internal pressure of the chambers 105) can be variable. In some embodiments, the chambers 105 can be selectively expanded and deflated by varying the internal pressure therein. When expanded, the chamber members 104 can press into and compress the extremity, and when deflated the chamber members 104 can at least partially release the extremity. This process can be repeated cyclically for improving circulation, etc.

Furthermore, the compression device 100 can include a foot pump member 103. The foot pump member 103 can include a bladder 106 that is operable to be disposed underneath a foot 142 of the user 108. For instance, the foot pump member 103 can be operably supported by an article of footwear 144 (e.g., a shoe, a boot, a sandal, etc.). The foot pump member 103 can be embedded within a midsole 148 of the footwear 144 or other part of the sole structure 146 of the footwear 144. The bladder 106 can be selectively removable from the sole structure 146 in some embodiments.

Also, the bladder 106 can be in fluid communication with one or more of the chamber members 104 via a tube 150 or other fluid conduit. The tube 150 may include a regulator that regulates fluid flow therethrough in either direction.

A fluid (e.g., air or another gas or liquid or gel) can flow between the bladder 106 and the chamber members 104. The amount of fluid can be fixed (i.e., the fluid system can be a closed fluid system shut off to the outside), or the amount of fluid can be variable (i.e., the fluid system can a selectively open fluid system to allow movement of fluid in or out). Those chamber members 104 that are in communication with the bladder 106 can be pressurized (i.e., the internal pressure of the chamber members 104 can be selectively increased) as a result of being stepped upon the user 108. Stepping off the bladder 106 can allow the chamber members 104 to at least partially deflate. Accordingly, walking, running, or otherwise moving normally while wearing the device 100 can cause the device 100 to cyclically compress and release the extremity of the user 108 as will be discussed in greater detail below.

Referring now to FIGS. 1 and 2, embodiments of the support member 102 will be discussed in greater detail. The support member 102 can be a flexible sheet of material. Any suitable materials can be used. For example, the support member 102 may include a breathable material that permits moisture to be wicked away from the user's leg during use. Also, the support member 102 can be substantially rectangular in shape, or the support member 102 can have a different shape (e.g., to fit snugly over the contours of the user's body). In the embodiments of FIGS. 1 and 2, the chamber members 104 are attached to the support member 102 such that the support member 102 is spaced away from the leg of the user 108.

Moreover, the support member 102 can include a first end 110, a second end 112, a proximal edge 111, and a distal edge 113. In the embodiments illustrated, the support member 102 can be wrapped around the extremity, and the first end 110 and the second end 112 can be selectively securable to each other such that the proximal edge 111 is disposed proximally on the extremity and the distal edge 113 is disposed distally on the extremity of the user 108. In the embodiments illustrated, the first and second ends 110, 112 are removably secured to each other via pile tape or hook-and-loop tape (e.g., VELCRO™). The ends 110, 112 can also be secured to each other via snaps, buttons, buckles, etc. Also, in some embodiments, the first and second ends 110, 112 can be more permanently secured via stitching or other means.

In some embodiments, the support member 102 can also include rigid rods or other rigid devices that support the anatomy (e.g., support movement of an anatomical joint) such that the support member 102 can operate as a brace (e.g., a knee brace, an elbow brace, etc.). Also, while the support member 102 can be flexible to wrap around the extremity, the support member 102 can be nonelastic, non-extendable, etc. As such, expansion or inflation of the chamber members 104 can result in compression of the extremity instead of extension of the support member 102. However, in additional embodiments, the support member 102 can be somewhat resilient and elastic so as to permit the user 108 to fit the support member 102 over the extremity while becoming snug enough to apply compression to the extremity.

Referring now to FIGS. 1, 2, and 3A-3C, various embodiments of the chamber members 104 will be discussed. As shown in FIG. 2, the chamber members 104 can be generally rounded, cylindrical, columnar and hollow so as to define the respective chamber 105 therein. However, the chamber members 104 can have any suitable shape.

The chamber members 104 can be spaced apart from each other at any suitable distance. The plurality of chamber members 104 may be spaced apart from one another by a uniform distance or by varying distances. In additional embodiments, at least two of the chamber members 104 can be directly adjacent each other so as to abut each other.

Also, the chamber members 104 can be permanently attached to the support member 102 (e.g., via adhesives, cement, molding, etc.). In additional embodiments, the chamber members 104 can be removably connected to the support member 102 (e.g., via pile tape, snaps, buttons, etc.). Also, some of the chamber members 104 can be permanently attached while others can be removably attached.

All of the chamber members 104 of the device 100 can have a similar shape, or in the embodiments shown, the device 100 can include a variety of differently shaped chamber members 104. For instance, as shown in FIG. 2, the device 100 can include a plurality of first chamber members 121 and a plurality of second chamber members 123 (projectable chamber members) having substantially different shapes. The first chamber members 121 can be arranged in a first row 128 that is adjacent and substantially parallel to the proximal edge 111. The second chamber members 123 can be arranged in rows and columns below the first chamber members 121.

Figure 3A:
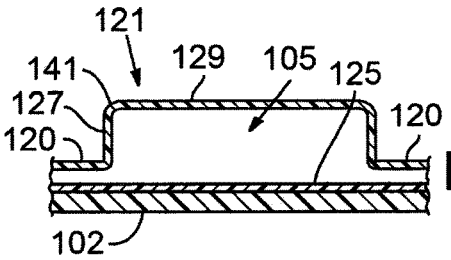
FIG. 3A is a section view of exemplary embodiments of a chamber member of the compression device taken along the line 3A-3A of FIG. 2.

As shown in FIG. 3A, the first chamber members 121 can include a flat, circular base wall 125 that is adjacent and attached to the support member 102, a cylindrical sidewall 127 that is attached to and that extends away from the base wall 125, and a substantially flat, circular top wall 129 that is attached to the sidewall 127 and that is spaced away from the base wall 125. The walls 125, 127, 129 can substantially define the respective chamber 105 of the first chamber member 121. One or more of the walls 125, 127, 129 can be resiliently elastic such that the walls 125, 127, 129 can resiliently expand and retract according to the pressure inside the chamber 105. As such, the volume of the chamber 105 can be selectively expanded (i.e., inflated) and reduced (i.e., deflated). In some embodiments, the walls 125, 127, 129 can expand substantially in at least two orthogonal directions (e.g., normal to the support member 102 and radially from the center of the chamber 105) so that the overall cylindrical shape of the first chamber members 121 does not substantially change when being inflated and deflated.

Also, the first chamber members 121 can be fluidly connected via respective channels 120. The channels 120 can be fixedly attached to the support member 102 in some embodiments. Furthermore, at least a portion of the first chamber members 121 can be fluidly connected in series via respective channels 120. However, at least some of the chamber members 121 could be fluidly connected in parallel without departing from the scope of the present disclosure.

It will be appreciated that the top wall 129 can press against and abut the extremity of the user 108. As pressure inside the chambers 105 increases, the top wall 129 can move toward and compress the extremity. Thus, the top walls 129 can collectively compress the extremity as will be discussed in greater detail below.

Figure 3B:
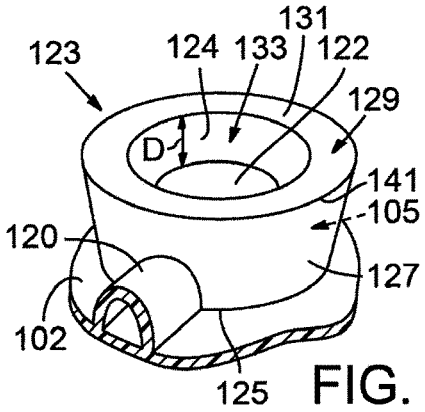

As shown in FIG. 3B, the second chamber members 123 can include base walls 125 and sidewalls 127 that are substantially similar to those discussed above. However, the top wall 129 of the second chamber members 123 can include a first portion 131 (peripheral portion) and a second portion 133 (recessable/projectable portion). The first portion 131 can be annular in shape. The second portion 133 can be centered within and surrounded by the first portion 131. The second portion 133 can have an invertable wall 124 and a floor 122.

The second portion 133 can have a recessed position (FIG. 3B) and an extended position (FIG. 3C) relative to the first portion 131. In the recessed position (FIG. 3B), the invertable wall 124 and floor 122 can be recessed below the first portion 131, and in the extended position (FIG. 3C), the invertable wall 124 and floor 122 can be projected away from the first portion 131. The pressure inside the chamber member 123 can be varied to move the second portion 133 between the recessed position and the extended position. In some embodiments, the recessed position (FIG. 3B) can be the neutral state of the second chamber member 123 (i.e., the second chamber member 123 can be biased toward the recessed position).

Figure 3C:
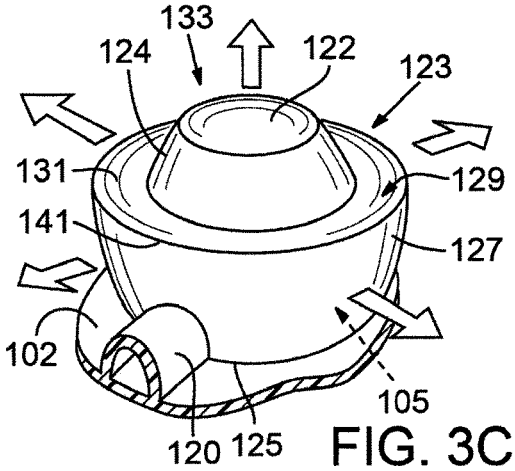

More specifically, assuming that the chamber member 123 is in the recessed position (FIG. 3B), the pressure inside the chamber 105 can increase beyond a predetermined threshold, causing the invertible wall 124 to invert and move to the extended position (FIG. 3C). Once pressure is reduced below the threshold, the second chamber 123 can resiliently recover and return to the recessed position (FIG. 3B).

As shown in FIG. 2, second chamber members 123 of the device 100 can have differently sized second portions 133. For instance, in the illustrated embodiments, second portions 133 nearer the distal edge 113 can have smaller diameters than second portions 133 further from the distal edge 113. The diameter of the second portions 133 are progressively larger in the direction from the distal edge 113 to the proximal edge 111. However, it will be appreciated that the second portions 133 of all the second chamber members 123 can be substantially equal in size without departing from the scope of the present disclosure. Moreover, a depth D of the floor 122 below the first portion 131 can be defined as shown in FIG. 2. In some embodiments, the depth D of the floor 122 is substantially equal for each of the second chamber members 123. However, in additional embodiments, the depth D of the floor 122 varies among different chamber members 123. For instance, in some embodiments, the depth D of the floors 122 nearer the distal edge 113 can be greater than the depth D of the floors 122 nearer the proximal edge 111.

As shown in FIGS. 3B and 3C, a transition 141 can be defined between the top wall 129 and sidewall 127. In the embodiments illustrated, the transition 141 is a relatively sharp edge; however, the transition 141 can be rounded at any suitable radius. Similar transitions 141 can be defined between the first and second portions 131, 133 and between the invertable wall 124 and floor 122. Moreover, similar transitions 141 can be defined between the top wall 129 and the sidewall 127 of the first chamber members 121 (FIG. 3A).

The second chamber members 123 can also be fluidly connected to each other via respective channels 120. As shown in FIGS. 3B and 3C, the channels 120 can be arch-shaped and the cross sectional area can be substantially fixed and non-expandable. In some embodiments, at least a portion of the second chamber members 123 can be fluidly connected in series. However, at least some of the second chamber members 123 can be fluidly connected in parallel without departing from the scope of the present disclosure.

Example embodiments of the plumbing (i.e., fluid connections) between the plurality of chamber members 104 are illustrated in FIG. 2. As shown, the chamber members 104 in each (horizontal) row can be fluidly connected in series. Also, the chamber members 104 in the (vertical) column closest to the first end 110 can be fluidly connected in series. The tube 150 can be directly and fluidly connected to the chamber member 104 located closest to the intersection of the distal edge 113 and the first end 110. Thus, it will be appreciated that fluid can flow from the tube 150 to the chamber members 104 through the column that is closest to the first end 110 and along each row of chamber members 104. Fluid can backflow along each row of chamber members 104, through the column adjacent the first end 110 and into the tube 150. It will be appreciated, however, that the plumbing could be configured in other ways to generate desirable fluid flow therethrough.

Accordingly, to increase internal pressure within the chamber members 104, the user 108 can step on and apply weight to the bladder 106 (FIG. 1). Fluid within the bladder 106 can flow through the tube 150 and into the chamber members 104 to increase pressure therein and to compress the extremity of the user 108. Removal of the load from the bladder 106 can allow fluid to flow back from the chamber members 104 to the bladder 106 to decrease pressure in the chamber members 104 to partially release the extremity of the user 108. This process can be repeated to cyclically pressurize and depressurize the chamber members 104 to promote healthy blood circulation, etc.

During this process of pressurization and de-pressurization, the pressure and volume in one or more of the chambers 105 can change at approximately the same rate. Also, in some embodiments, the respective pressures and volumes can change at substantially different rates. The difference in the pressure/volume change rate can be a function of the different shapes of the chamber members 104, the different positions of the chamber members 104 relative to the hose 150, different cross sectional areas for different channels 120, different resiliencies of the materials of the chamber members 104, etc. Valves can also be incorporated within the chamber members 104 and/or channels 120 for restricting fluid flow and controlling the change in volume/pressure.

One or more sensors can also be operably coupled to the chamber members 104, the channels 120, the tube 150, and/or the bladder 106 to detect the pressure therein. The device 100 can additionally include a controller that automatically controls fluid flow into the chamber members 104 according to the detected pressure. Furthermore, a timer can be incorporated into the device for tracking time intervals between compression and release of the extremity. The controller can automatically pressurize and de-pressurize the chamber members 104 according to these time intervals. Furthermore, the sensor can be a motion sensor, a weight sensor, an accelerometer, and an inclinometer for detecting motion, weight loads, acceleration, and grade, respectively, and the controller can control pressurization according to these detected variables.

Additionally, in some embodiments, the pressure in a first group of the plurality of chamber members 104 is variable as discussed above while the pressure in a second group of the plurality of chamber members 104 remains static. Accordingly, compression and release of the extremity can be targeted to specific areas of the anatomy.

Figure 6C:
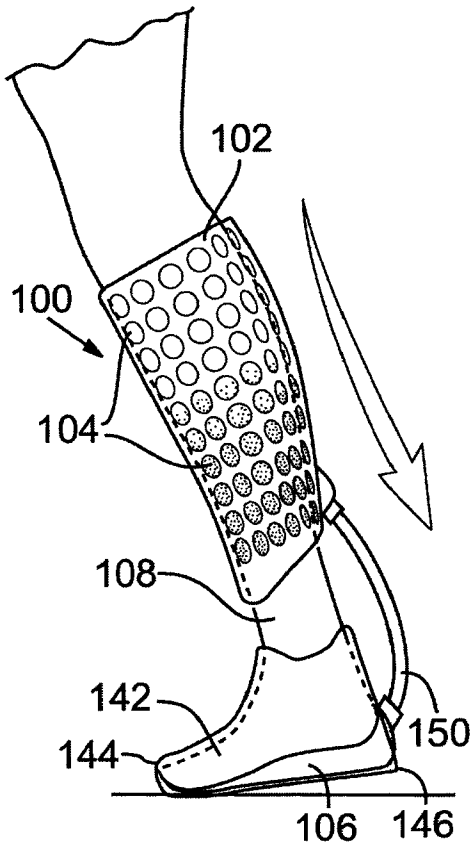
FIGS. 6A-6C are side views of the compression device shown as a user walks or runs.
Figure 6B:
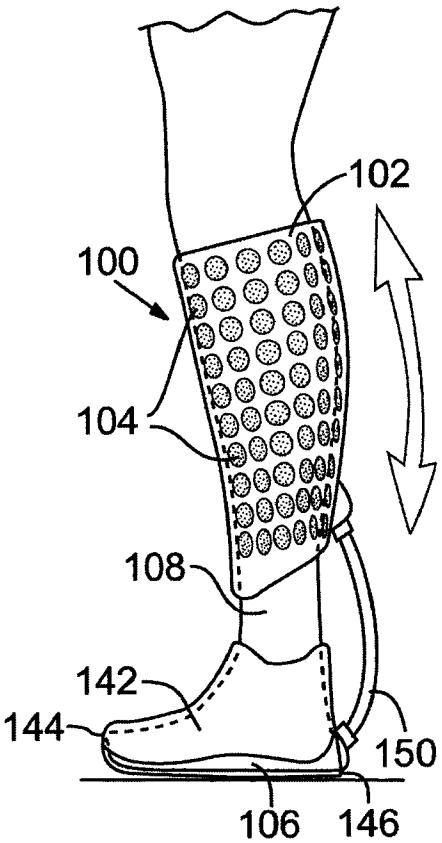
Figure 6A:
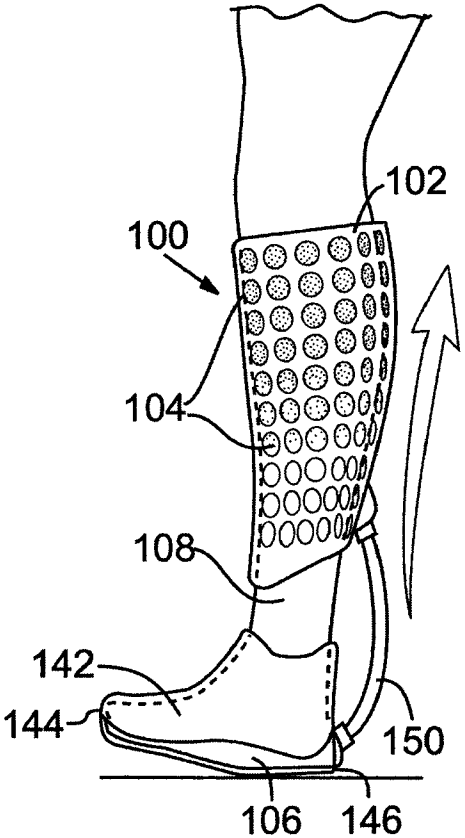

As shown in FIGS. 6A-6C, fluid flow through the device 100 can be controlled by the user's step cycle. FIG. 6A illustrates the beginning of the user's step cycle when the lateral portion of the heel region of the user's foot 142 strikes the ground. As shown, the weight of the user and any other additional loads can force fluid in the bladder 106 to flow through the tube 150 and be distributed in the chamber members 104 as represented by the arrow in FIG. 6A. Then, as the user 108 progresses through the step-cycle (FIG. 6B) and weight shifts anteriorly, fluid can continue to flow between the chamber members 104 and some of the fluid can start to flow back toward the bladder 106 as represented by the double headed arrow. Subsequently, as shown in FIG. 6C, as the user 108 begins to lift the heel, fluid can flow from the chamber members 104 back into the bladder 106 as represented by the arrow. This process can be repeated cyclically through many step cycles.

It will be appreciated that the pressure in the chamber members 104 disposed distally can be different than that of the chamber members 104 disposed proximally in the different stages of the step-cycle. (The difference in pressure is represented by shading in FIGS. 6A-6C, wherein darker shading in the chamber members 104 represents higher pressure and vice versa.) The pressure in the proximally disposed chamber members 104 can be highest when the step cycle begins, as illustrated by FIG. 6A. Through the middle of the step cycle (FIG. 6B), the fluid can flow move evenly between the proximal and distal chamber members 104. Then, at the end of the step-cycle, fluid pressure can be highest in the distally disposed chamber members 104 as shown in FIG. 6C.

It will be appreciated that the amount of fluid forced into any particular chamber members 104 and the corresponding pressure change therein can be controlled by the size and shape of the chamber members 104 and interconnecting channels 120. Fluid flow can also be controlled by the size, shape, and/or positioning of the bladder 106, one or more control valves present between the bladder 106 and the chamber members 104, and the like.

Figure 4:
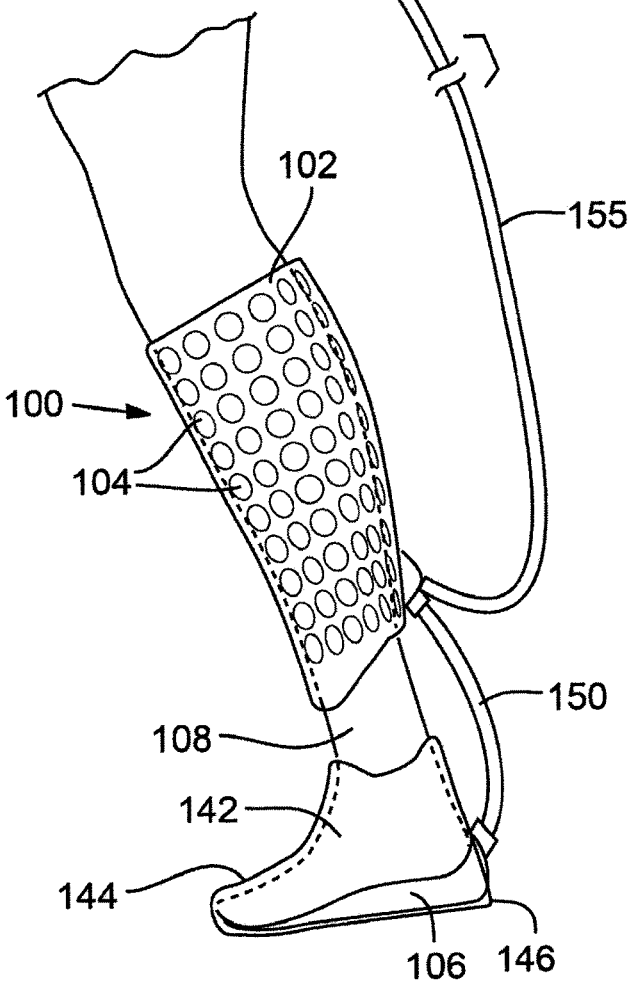
FIG. 4 is a side view of the compression device with a secondary handheld pump.
Figure 5:
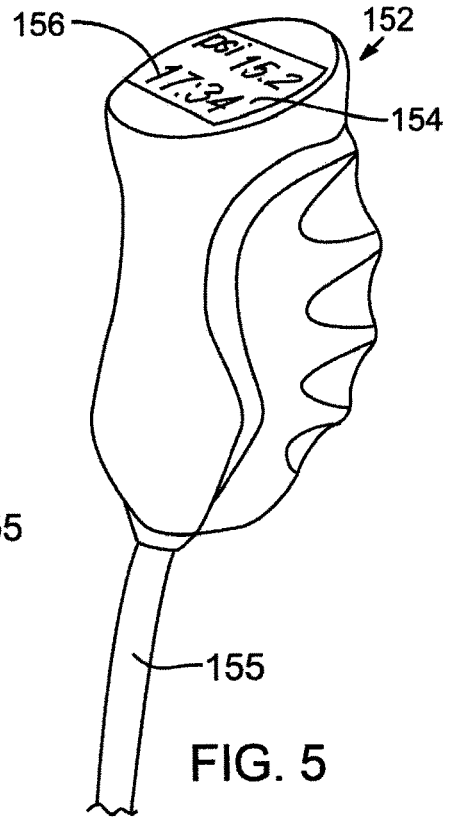
FIG. 5 is a perspective view of the handheld pump of FIG. 4.

As shown in FIGS. 4 and 5, the compression device 100 can also include a secondary pump 152. The pump 152 can be largely handheld and can include a display 154 and a secondary hose 155. The secondary hose 155 can removably and fluidly connect to the support member 102, adjacent the hose 150. The display 154 can display any suitable type of information (e.g., the pressure of one or more of the chamber members 104 and a clock 156). The clock 156 may be a timing device that deactivates pumping from the secondary pump 152 or the bladder 106 after a designated amount of time. In the example illustrated in FIGS. 4 and 5, the clock 156 shows seventeen minutes and thirty four seconds remain in the designated amount of time that cyclic pumping through the device 100 will occur. The clock 156 may be configured to cause the compression device 100 to activate for a designated amount of time, such as twenty minutes in some examples.

Figure 7A:
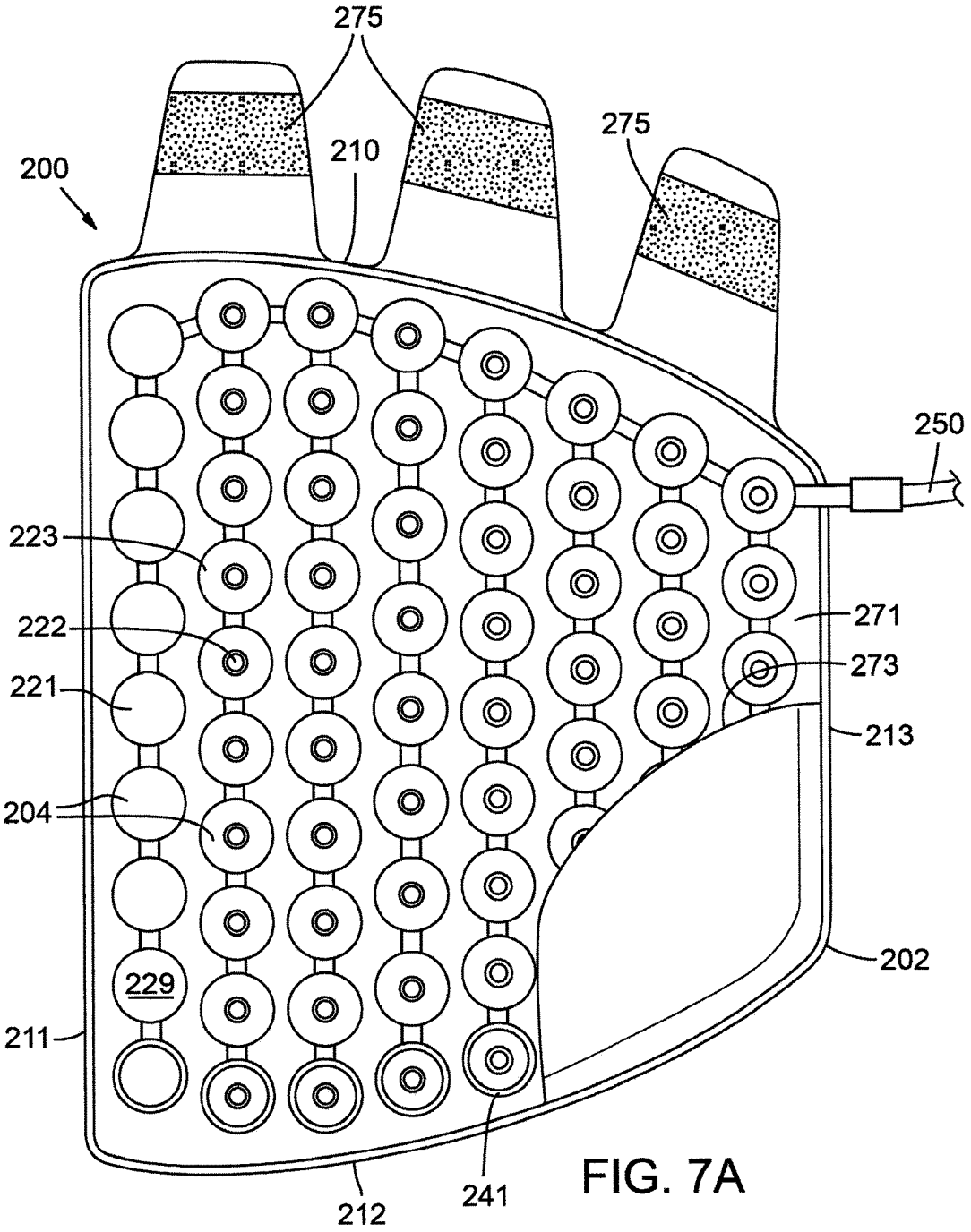
FIG. 7A is a plan view of the compression device according to additional exemplary embodiments.
Figure 7B:
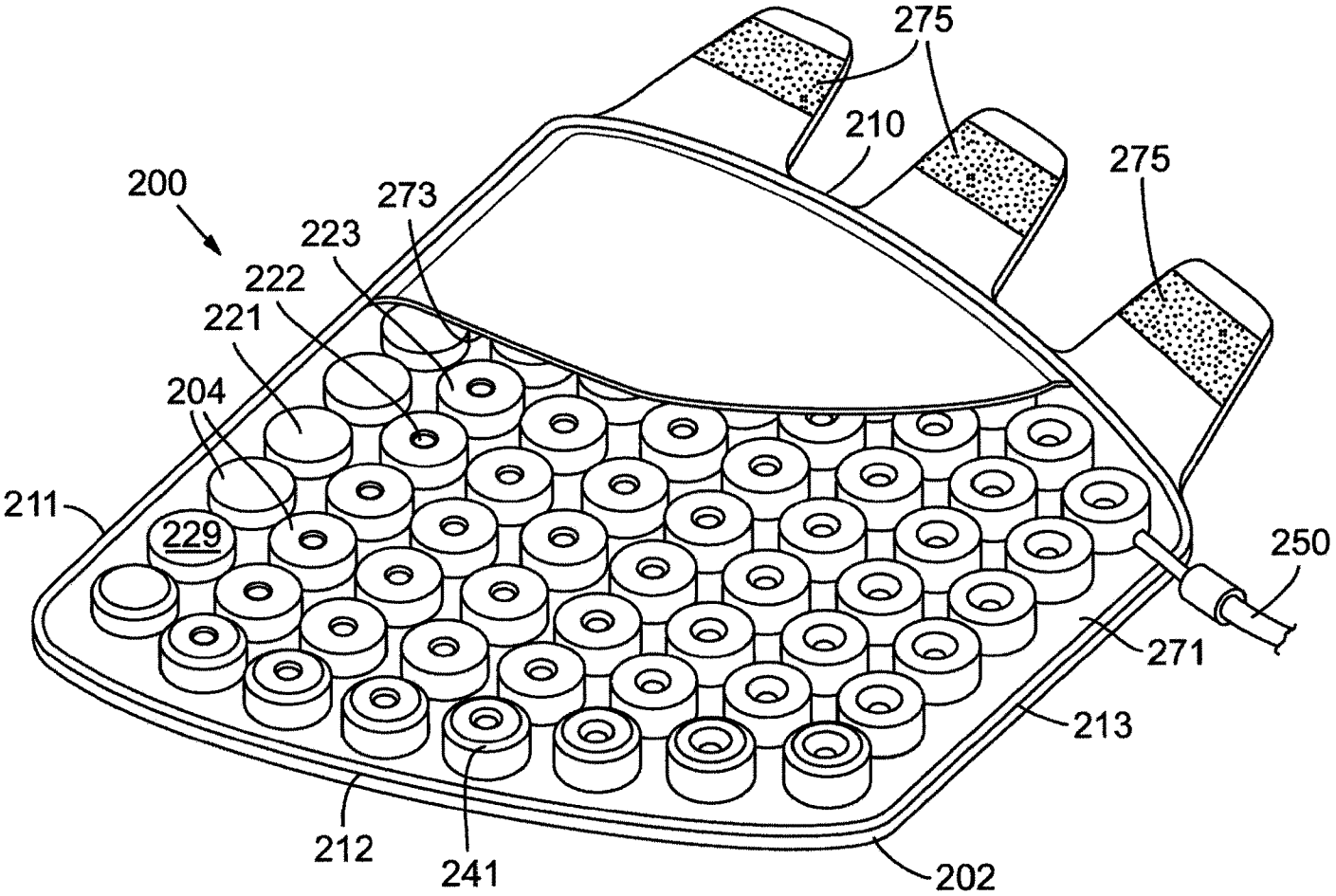
FIG. 7B is a perspective view of the compression device of FIG. 7A.

Referring now to FIGS. 7A and 7B, additional embodiments of the device 200 are illustrated according to various embodiments. Components that correspond to those of the embodiments of FIGS. 1-6C are indicated by corresponding reference numbers increased by 100.

As shown, the device 200 can include the support member 202. The support member 202 can include an outer sheet 271 and an inner sheet 273 (partially shown). The chamber members 204 can be disposed between the outer and inner sheets 271, 273. When worn, the inner sheet 273 can be disposed directly adjacent the user's body, and the outer sheet 271 and chamber members 204 can be spaced from the user's body. The inner sheet 273 can be made from an absorbent material to wick away perspiration or other moisture from the user's body and to provide comfort.

Also, the support member 202 can include a first end 210 and a second end 212. The first end 210 can include straps 275 that extend therefrom. The straps 275 can include hook or loop tape, and the second end 212 can include the other of the hook and loop to fasten to the straps 275 and to secure the device 200 to the user's body.

Furthermore, the support member 202 can define a proximal edge 211 and a distal edge 213. The width of the support member 202 can taper downward gradually from the proximal edge 211 to the distal edge 213. As such, the device 200 can better fit the anatomical contours of the user's body.

Moreover, the chamber members 204 can be arranged across the support member 202. As shown, the chamber members 204 can vary in shape. For instance, as shown, first chamber members 221 with substantially flat top walls 229 can be disposed adjacent to the proximal edge 211. Second chamber members 223 with partially recessed top walls 229 can be disposed in rows below the first chamber members 221. Also, as shown, the floor 222 of the second chamber members 223 can be progressively deeper in the distal direction. Additionally, the radius of the transitions 241 can be progressively greater in one or more directions across the support member 202. For instance, the radius of the transitions 241 can be progressively greater in the direction from first end 210 to the second end 212. It will be appreciated that the shapes of the chamber members 204 can vary across the device 200 in any manner to thereby better fit and conform to the user's body. Also, it will be appreciated that the shape of each of the chamber members 204 can be substantially the same without departing from the scope of the present disclosure.

In some examples, any one or more embodiments of the compression device 100, 200 can be included within a kit containing the device 100, 200, one or more replaceable bladders, one or more replaceable leg wraps, replacement tubes, an optional secondary pump, and/or any other suitable items. In some examples, the kit also includes an article of footwear such that the bladder (or other actuator) is capable of being embedded within the sole structure of the article of footwear. The duplicative elements that are included in the kit embodiment may be used for replacing worn or damaged elements and/or may be used for changing the appearance of any one or more elements or the entire device. Thus, users can customize their compression devices 100, 200 with replaceable elements from the kit.

Optional features may be added to any of the aspects of the impact-attenuating elements described above. For instance, the compression device 100 illustrated in FIG. 1 includes the bladder 106 embedded within the sole structure of the midfoot and heel region of the article of footwear. The bladder can be embedded in any one or more regions of the article of footwear (the forefoot region, the midfoot region, and/or the heel region) in other examples. Further, the bladder 106 in FIG. 1 includes a single chamber. In other examples, the bladder 106 may include more than one chamber (e.g., a first bladder chamber embedded within the heel region of the sole structure and a second bladder chamber embedded within the forefoot region of the sole structure). In this latter example, the first bladder chamber and the second bladder chamber may be in fluid communication with each other or may be discrete elements. Also, the first and second bladder chambers are each in fluid communication with at least one chamber member in the compression device.

The disclosed compression devices 100, 200 have many suitable applications. For example, the compression devices 100, 200 may be used by athletes after or during a break from a workout or competition to speed the recovery of the leg or other extremity being treated. The compression devices 100, 200 also may be used during exercise or training to increase the endurance of the wearer's extremity. The disclosed compression devices 100, 200 also are suitable for helping patients recover from injury, surgery, or other medical conditions that weaken or decrease the ability of the wearer's body to circulate fresh blood into the leg (or other extremity).

Individual elements or features of a particular aspect of the disclosed compression devices are generally not limited to that particular aspect, but, where applicable, are interchangeable and can be used in a selected aspect, even if not specifically shown or described. The same also may be varied in many ways. Such variations are not to be regarded as a departure from the disclosure, and all such modifications are intended to be included within the scope of the disclosure.

We claim:

1. A device for compressing an extremity of a user, the device comprising:
   - a sole structure including a midsole;
   - a pump member supported by the midsole and operable to compress a fluid in response to a predetermined load being applied to the sole structure;
   - a support member spaced apart from the pump member and operable to extend at least partially around the extremity of the user;
   - a conduit in fluid communication with the pump member and extending between the pump member and the support member; and
   - a plurality of chamber members, each chamber member (i) extending from the support member, (ii) selectively receiving pressurized fluid from the pump member via the conduit, and (iii) including a top wall spaced apart from the support member and having a first portion and a second portion surrounded by the first portion, the second portion of the top wall movable from a first position recessed from the first portion to a second position extending from the first portion as a result of the pressurized fluid being delivered to each chamber member by the conduit.

2. The device of claim 1, wherein the sole structure extends from a forefoot portion of the sole structure to a heel portion of the sole structure.

3. The device of claim 1, wherein the pump member includes a bladder embedded within the midsole.

4. The device of claim 3, wherein the bladder is selectively removable from the sole structure.

5. The device of claim 3, wherein the bladder extends from a heel portion of the sole structure to a midfoot portion of the sole structure.

6. The device of claim 3, wherein the bladder is spaced apart from a forefoot portion of the sole structure.

7. The device of claim 1, wherein the conduit extends from the sole structure along an outer surface of an upper of an article of footwear associated with the sole structure.

8. The device of claim 1, wherein the first portion and the second portion are concentric.

9. A device for compressing an extremity of a user, the device comprising:
   - a sole structure including a midsole;
   - a pump member supported by the midsole and operable to compress a fluid in response to a predetermined load being applied to the sole structure;
   - a support member spaced apart from the pump member and operable to extend at least partially around the extremity of the user;

a conduit in fluid communication with the pump member and extending between the pump member and the support member; and a plurality of chamber members, each chamber member (i) extending from the support member, (ii) selectively receiving pressurized fluid from the pump member via the conduit, and (iii) including a top wall spaced apart from the support member and movable from an inverted position extending in a direction toward the support member to an extended position extending in a direction away from the support member as a result of the pressurized fluid being delivered to the chamber members by the conduit.

10. The device of claim 9, wherein the conduit is operable to selectively deliver pressurized fluid received from the pump member to the device.

11. The device of claim 9, wherein the conduit extends from an outer surface of the sole structure.

12. The device of claim 9, wherein an upper of an article of footwear is associated with the sole structure, the upper being spaced apart and separated from the support member by a gap.

13. The device of claim 12, wherein the conduit spans the gap between the upper and the support member.

14. The device of claim 9, wherein the sole structure extends from a forefoot portion of the sole structure to a heel portion of the sole structure.

15. The device of claim 9, wherein the pump member includes a bladder embedded within the midsole.

16. The device of claim 15, wherein the bladder is selectively removable from the sole structure.

17. The device of claim 15, wherein the bladder extends from a heel portion of the sole structure to a midfoot portion of the sole structure.

18. The device of claim 15, wherein the bladder is spaced apart from a forefoot portion of the sole structure.

19. The device of claim 9, wherein the top wall includes a first portion and a second portion surrounded by the first portion, the second portion recessed from the first portion in the inverted position and extending from the first portion in the extended position.

* * * * *